US010508471B2

(12) United States Patent
Chen

(10) Patent No.: US 10,508,471 B2
(45) Date of Patent: Dec. 17, 2019

(54) MULTIPLE-LATCH-LOCKING LOCK STRUCTURE

(71) Applicant: Te-Yu Chen, Pingtung (TW)

(72) Inventor: Te-Yu Chen, Pingtung (TW)

( * ) Notice: Subject to any disclaimer, the term of this patent is extended or adjusted under 35 U.S.C. 154(b) by 312 days.

(21) Appl. No.: 15/464,332

(22) Filed: Mar. 20, 2017

(65) Prior Publication Data

US 2018/0266152 A1 Sep. 20, 2018

(51) Int. Cl.
*E05B 59/00* (2006.01)
*E05B 55/12* (2006.01)

(52) U.S. Cl.
CPC ..... *E05B 59/00* (2013.01); *E05B 55/12* (2013.01)

(58) Field of Classification Search
CPC ..... E05B 59/00; E05B 55/12; E05B 13/002; E05B 13/004; E05B 17/2007; E05B 17/2011; E05B 17/2015; E05B 17/2084; E05B 55/00
USPC ..... 292/56, 32, 34, 36, 37; 70/107–111
See application file for complete search history.

(56) References Cited

U.S. PATENT DOCUMENTS 4,118,056 A * 10/1978 Alexander ..... E05B 59/00 292/169
4,389,061 A * 6/1983 Foshee ..... E05B 59/00 292/169.14
2004/0089033 A1* 5/2004 Lu ..... E05B 59/00 70/107
2012/0139267 A1* 6/2012 Chen ..... E05B 15/04 292/56
2012/0299315 A1* 11/2012 Chen ..... E05B 47/0673 292/144
2013/0328324 A1* 12/2013 Chen ..... E05B 63/18 292/71
2014/0042757 A1* 2/2014 Chen ..... E05B 13/005 292/341.15

* cited by examiner

*Primary Examiner* — Nathan Cumar
(74) *Attorney, Agent, or Firm* — Leong C. Lei

(57) ABSTRACT

A multiple-latch-locking lock structure includes a casing in which a lock tongue control unit and a lock latch control unit are arranged. The lock tongue control unit includes an operation-linking member, a positioning member, an arresting member, a swinging member, and a slide block. When a lock core is rotated, the rectangular lock tongue and the triangular lock tongue are driven to get pushed out and retracted back for latch-locking and unlocking. The lock latch control unit includes a rotating member, a slide plate, and a slide bar. When a handle is rotated, the lock latch is driven to get pushed out and retracted back, thereby achieving security latch-locking and the slide plate is caused to move up and down to achieve a function of controlling a vertical latch. As such, multiple latch locking can be achieved to provide the lock with better security and better burglary resistance.

4 Claims, 8 Drawing Sheets

MULTIPLE-LATCH-LOCKING LOCK STRUCTURE

TECHNICAL FIELD OF THE INVENTION

The present invention relates generally to a multiple-latch-locking lock structure, and more particularly to an improved lock structure that provides multiple latching functions to achieve enhanced security and burglary resistance.

DESCRIPTION OF THE PRIOR ART

A general lock structure comprises a rectangular bolt and a triangular primary latch and may additionally comprise a secondary latch operatively coupled to the primary latch. In a normal condition, the lock can be set in a locking condition through an operation conducted with a handle or a key. To set the locking condition from the indoor side, the known way that is commonly used is to operate an internal shaft and to set the locking condition from the outdoor side, a key is used to lock and release the lock. To improve the functions of security and burglary resistance, in addition to having the bolt and latch fit into a door frame to keep the door shut, some locks comprise additional locking device, such as a vertical latch, which provides a function of being operable in combination with the lock. However, the conventional vertical latch is generally of a standalone design and is not operable in combination with a lock, making it hard to achieve better use of such a function. In view of these problems, the present invention aims to provide an improved structure of a lock, which provides the lock with a function of multiple ways of latch-locking to thereby achieve the purpose of better security and burglary resistance.

SUMMARY OF THE INVENTION

The primary objective of the present invention is to provide a multiple-latch-locking lock structure, which provides a lock with multiple latch-locking including control of latch-locking and unlocking operations of bolts and latches and control of a vertical latch so as to achieve the purpose of better security and better burglary resistance of the lock.

The multiple-latch-locking lock structure comprises a casing and a lock tongue control unit and a lock latch control unit arranged in the casing, wherein the lock tongue control unit comprises various components including at least an operation-linking member, a positioning member, an arresting member, a swinging member, and a slide block such that through combination of such components, when a lock core is rotated, the rectangular lock tongue and the triangular lock tongue are driven for being pushed out and retracted back thereby achieving latch-locking and releasing/unlocking. The lock latch control unit comprises various components including at least a rotating member, a slide plate, and a slide bar such that through combination of such components, when a handle is rotated, the lock latch is driven for being pushed out and retracted back thereby achieving security latch-locking and the slide plate is driven to move up and down thereby achieving a function of controlling a vertical latch thereby providing a function of multiple latch-locking of the lock to improve security and burglary resistance of the lock.

The multiple-latch-locking lock structure is such that the lock tongue control unit comprises a slide block and a spring, wherein the slide block is provided, in an upper portion thereof, with a first positioning hole and a second positioning hole and is also provided, in a lower portion thereof, with a fitting hole, such that a point projection of the positioning member is fit into and received in the fitting hole, wherein when the positioning member swings to cause the rectangular lock tongue and the triangular lock tongue to get pushed out or retracted back, the slide block is driven to move up and down to allow the spring to get into engagement with the first positioning hole or the second positioning hole to achieve positioning.

The multiple-latch-locking lock structure is such that the slide plate of the lock latch control unit is provided with a cutoff and an elongate hole, such that the elongate hole is fit to a projecting pillar provided on the casing and the rotating member is set in the cutoff, wherein when a handle is rotated, the slide bar is driven to displace, causing the rotating member to rotate a predetermined angle for pushing the slide plate upward or downward thereby achieving a function of controlling a vertical latch.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
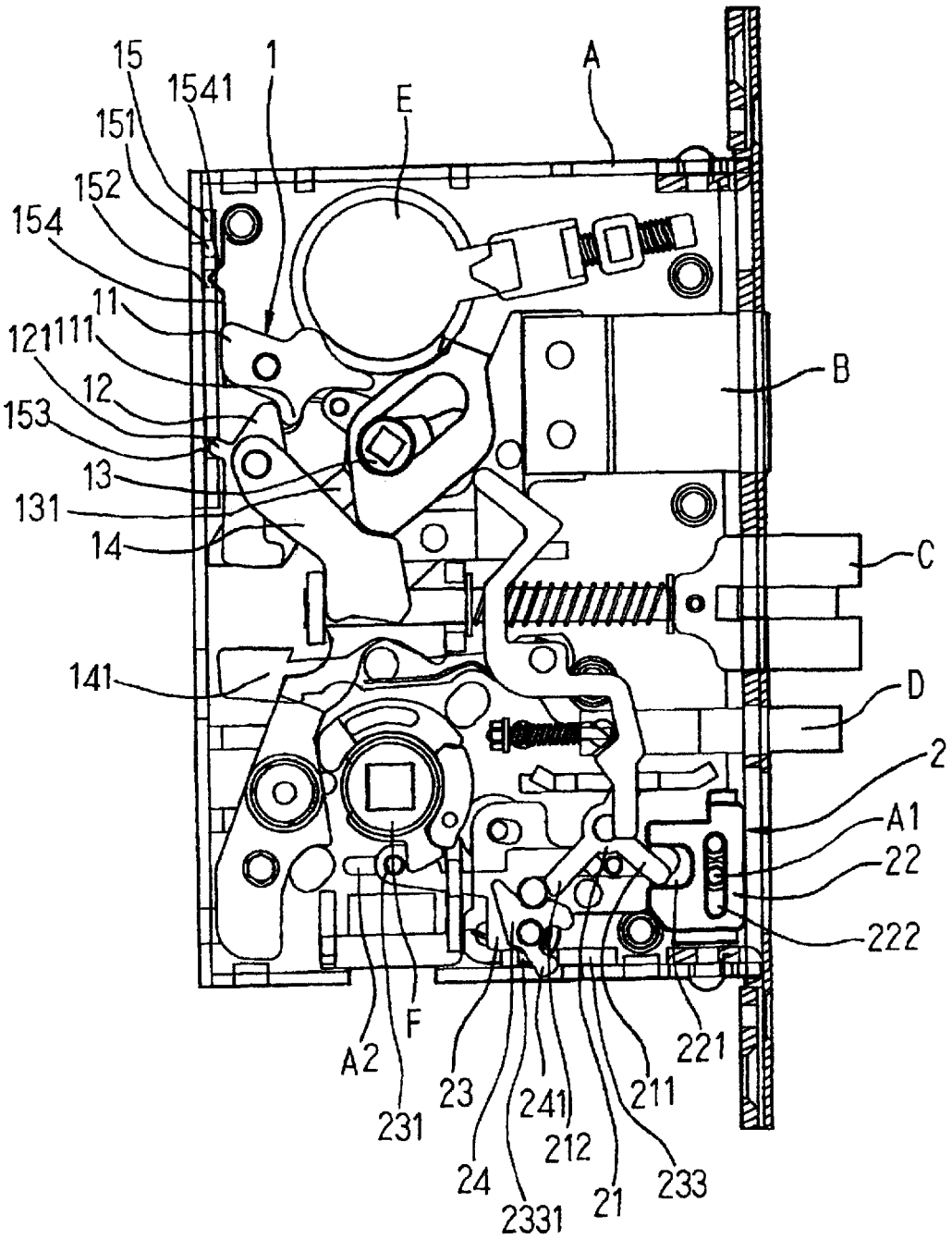
FIG. 1 is a schematic view showing a structure of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention comprises a casing A and a rectangular lock tongue B, a triangular lock tongue C, and a lock latch D; a lock core shaft E and a handle shaft F; and a lock tongue control unit 1 and a lock latch control unit 2 arranged in the casing A. The lock tongue control unit 1 comprises components including at least an operation-linking member 11, a positioning member 12, an arresting member 13, a swinging member 14, and a slide block 15. The lock latch control unit 2 comprises components including at least a rotating member 21, a slide plate 22 and a slide bar 23, and a positioning plate 24.

Figure 2:
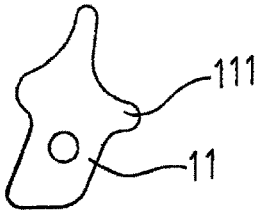
FIG. 2 is a schematic view showing an operation-linking member according to the present invention.

Referring to FIG. 2, which is a schematic view showing an operation-linking member according to the present invention, as shown in the drawing, the operation-linking member 11 is rotatably mounted to the casing A and is thus in a rotatable condition and comprises a pushing section 111.

Figure 3:
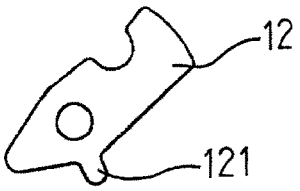
FIG. 3 is a schematic view showing a positioning member of the present invention.

Referring to FIG. 3, which is a schematic view showing a positioning member of the present invention, as shown in the drawing, the positioning member 12 is rotatably mounted to the casing A and located under the operation-linking member 11 and is in a rotatable condition and is provided with a point projection 121.

Figure 4:
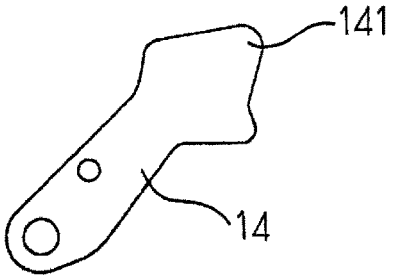
FIG. 4 is a schematic view showing a swinging member of the present invention.

Referring to FIG. 4, which is a schematic view showing a swinging member of the present invention, as shown in the drawing, the swinging member 14 has an end that is rotatably mounted to the casing A in a manner of overlapping the positioning member 12 and is in a rotatable condition and an opposite end that comprises a constraining section 141 comprises raised and recessed edge surfaces.

Figure 5:
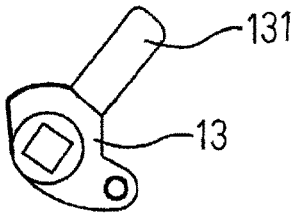
FIG. 5 is a schematic view showing an arresting member of the present invention.

Referring to FIG. 5, which is a schematic view showing an arresting member of the present invention, as shown in the drawing, the arresting member 13 is rotatably mounted to the casing A and is located under the operation-linking member 11 and is in a rotatable condition and is provided with a push bar 131.

The slide block 15 is arranged at an upper portion inside the casing A and is provided, in an upper portion thereof, with a first positioning hole 151 and a second positioning hole 152 and is also provided, in a lower portion thereof, with a fitting hole 153. Provided at the upper portion of the slide block 15 is a spring 154 that includes a point-tip protrusion 1541 such that the point-tip protrusion 1541 is fit into and received in the first positioning hole 151 or the second positioning hole 152 and the point projection 121 of the positioning member 12 is fit into and received in the fitting hole 153.

Through combination of the above-described components/parts, the lock tongue control unit 1 is such that the lock core shaft E, when put into rotation, drives the lock tongue control unit 1 that comprises the components including at least the operation-linking member 11, the positioning member 12, the arresting member 13, the swinging member 14, and the slide block 15 to allow the triangular lock tongue C to be pushed out and retracted back and to allow the lock latch D to be pushed out and retracted back thereby achieving latch-locking and unlocking.

Figure 6:
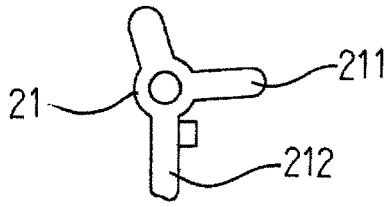
FIG. 6 is a schematic view showing a rotating member of the present invention.

Referring to FIG. 6, which is a schematic view showing a rotating member of the present invention, as shown in the drawing, the rotating member 21 is rotatably mounted to the casing A and is provided with a first push bar 211 and a second push bar 212 that is arranged to generally define an angle of 90 degrees with respect to the first push bar 211.

Figure 7:
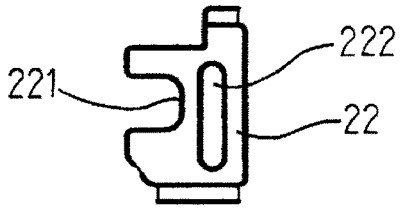
FIG. 7 is a schematic view showing a slide plate of the present invention.

Referring to FIG. 7, which is a schematic view showing a slide plate of the present invention, as shown in the drawing, the slide plate 22 is arranged under the rotating member 21 and is provided with a cutoff 221 and an elongate hole 222, such that the elongate hole 222 is fit over a projecting post A1 provided on the casing A and the first push bar 211 of the rotating member 21 is received in the cutoff 221.

Figure 8:
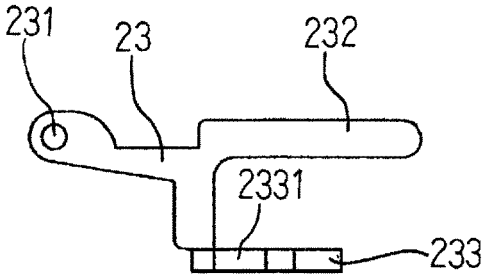
FIG. 8 is a schematic view showing a slide bar of the present invention.

Referring to FIG. 8, which is a schematic view showing a slide bar of the present invention, as shown in the drawing, the slide bar 23 is provided, at one end thereof, with a projecting pillar 231 to be received in an elongate hole A2 formed in the casing A and an opposite end having an upper portion and a lower portion that are respectively provided with an engagement bar 232 and a positioning rod 233, wherein the positioning rod 233 is provided with a positioning hole 2331.

Figure 9:
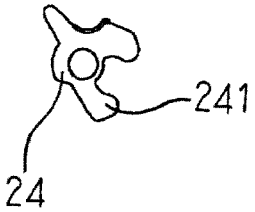
FIG. 9 is a schematic view showing a positioning plate of the present invention.

Referring to FIG. 9, which is a schematic view showing a positioning plate of the present invention, as shown in the drawing, the positioning plate 24 is rotatably mounted to the casing A and is provided with a projecting rod 241, such that the projecting rod 241 is fit into the positioning hole 2331 of the positioning rod 233 of the slide bar 23.

Through combination of the above-described components/parts, the lock latch control unit 2 is such that the handle shaft F, when put into operation, drives the lock latch D to be pushed out and retracted back so as to achieve security latch-locking and drives the slide plate 22 to move up and down thereby achieving a function of controlling a vertical latch and thus providing the lock with a function of multiple latch-locking and achieving the purpose of better security and burglary resistance of the lock.

Figure 10:
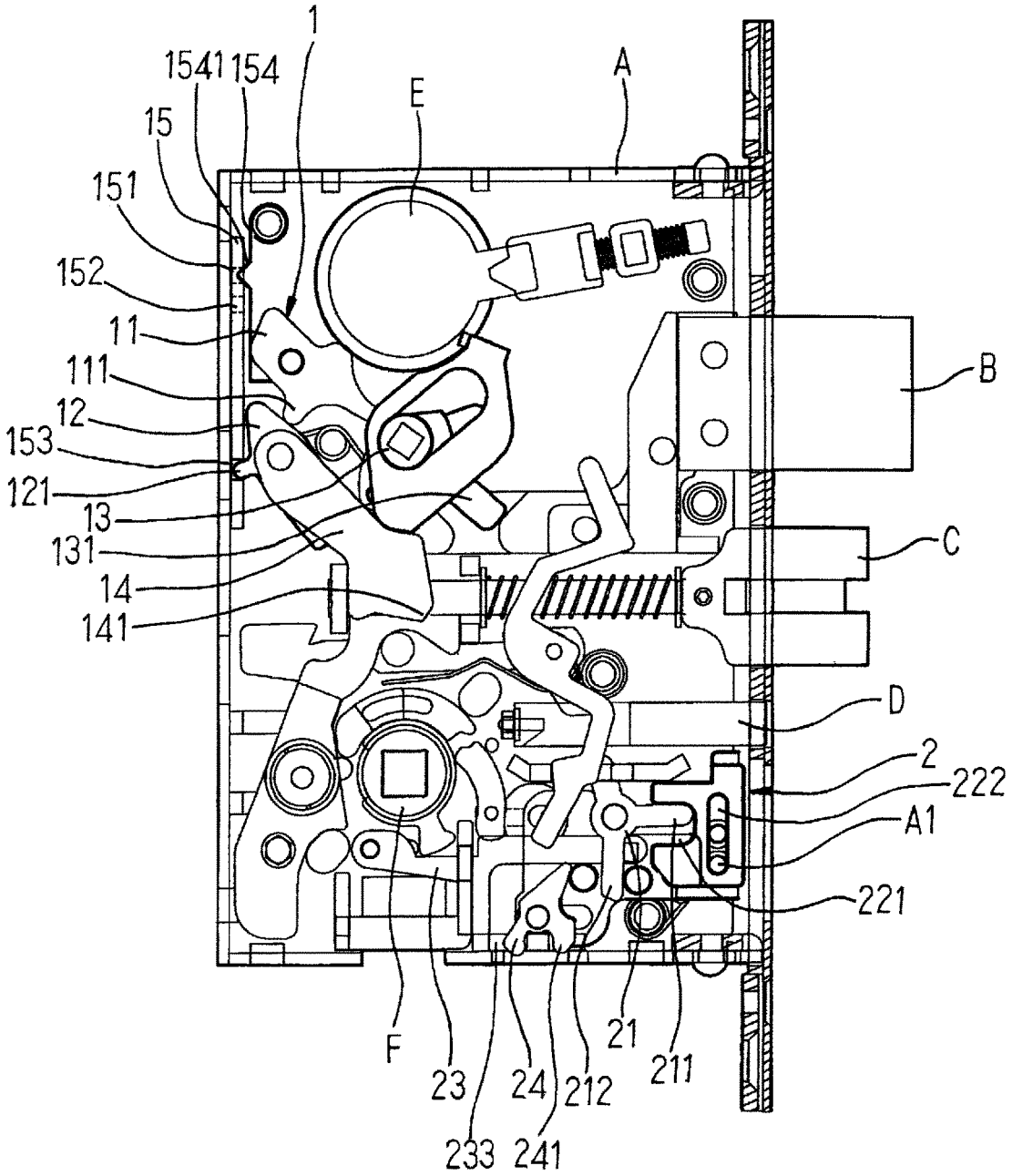
FIGS. 10 and 11 are schematic views illustrating conditions of operation of a rectangular lock tongue and a triangular lock tongue of the present invention.
Figure 11:
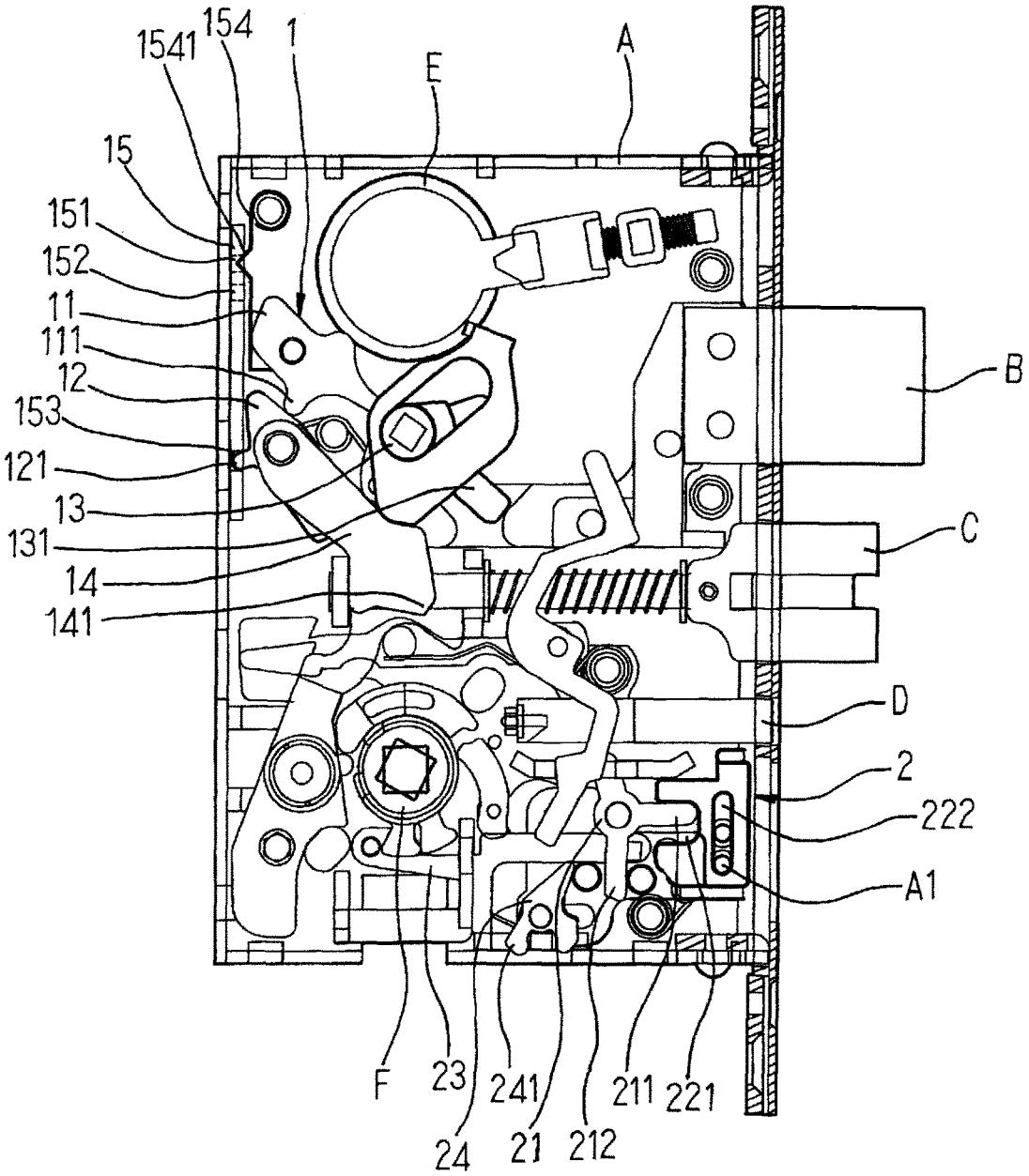

Referring simultaneously to FIGS. 10 and 11, which show conditions of operation of the rectangular lock tongue and the triangular lock tongue of the present invention, as shown in the drawings, the lock tongue control unit 1 of the present invention is such that with the lock core shaft E being put into rotation, the lock core shaft E is caused to rotate downward to drive the operation-linking member 11 to move downward and thus moving the positioning member 12 and the swinging member 14, and the arresting member 13, such that the arresting member 13 pushes the rectangular lock tongue B out of the casing A and also, the swinging member 14 pushes the triangular lock tongue C out of the casing A to achieve latch-locking. Oppositely, when the lock core shaft E is caused to rotated in a reversed direction, the rectangular lock tongue B and the triangular lock tongue C are retracted back to thus achieve releasing and unlocking. Since the point projection 121 of the positioning member 12 is fit in and received in the fitting hole 153 of the slide block 15, when the positioning member 12 swings and makes the rectangular lock tongue B and the triangular lock tongue C pushed out or retracted back, the slide block 15 is caused to move up and down to have the point-tip protrusion 1541 of the spring 154 engage with the first positioning hole 151 or the second positioning hole 152 to achieve a function of positioning thereby providing the lock with better security.

Figure 12:
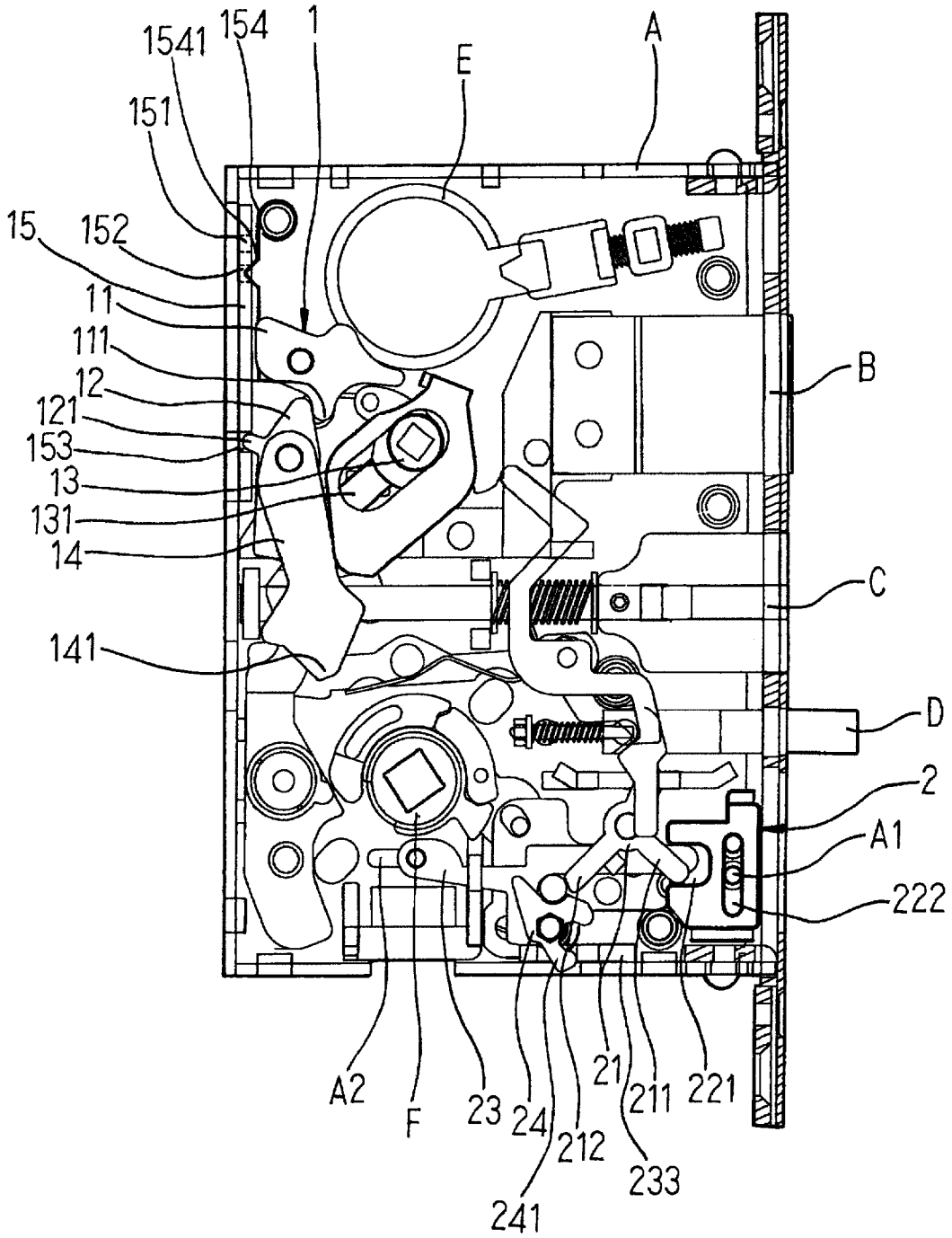
FIG. 12 is a schematic view illustrating a condition of operation of a lock latch of the present invention.

Referring to FIG. 12, which is a schematic view illustrating a condition of operation of the lock latch of the present invention, as shown in the drawing, the present invention is such that when the handle shaft F is put into rotation, the slide bar 23 is pushed forward to push out the lock latch D thereby achieving security latch-locking. Under this condition, the rotating member 21 is rotated by a predetermined angle to have the slide plate 22 move up and down thereby achieving a function of controlling a vertical latch so as to provide the lock with a function of multiple latch-locking and thus improving security and burglary resistance of the lock.

Figure 13:
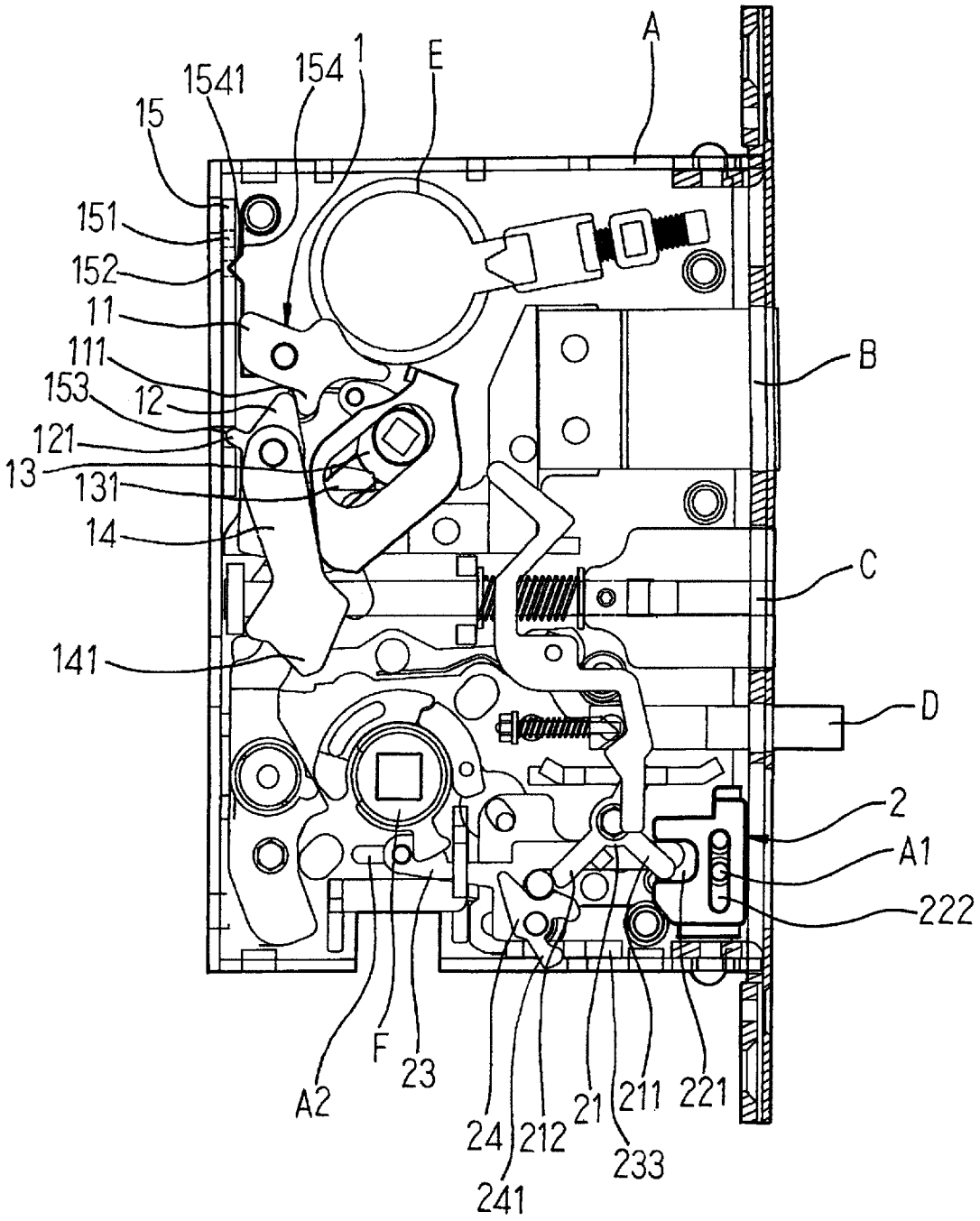
FIGS. 13 and 14 are schematic views illustrating conditions of operation of the slide plate of the present invention.
Figure 14:
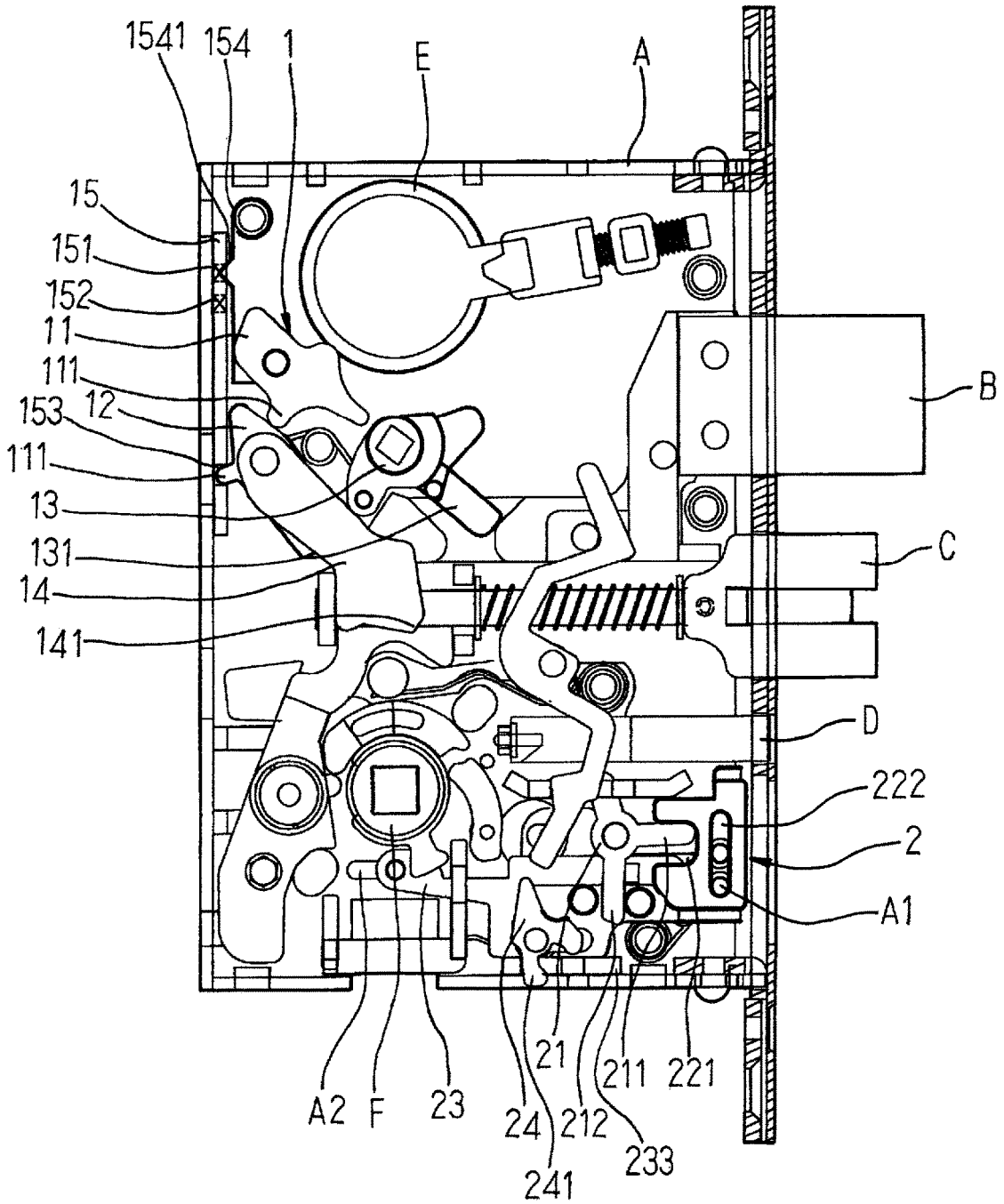

Referring simultaneously to FIGS. 13 and 14, which are schematic views illustrating conditions of operation of the slide plate of the present invention, as shown in the drawings, the present invention is such that when the handle shaft F is put into rotation, the slide bar 23 is pushed forward to push out the lock latch D thereby achieving security latch-locking and under this condition, since the first push bar 211 of the rotating member 21 is positioned in the cutoff 22, when the rotating member 21 is rotated by a predetermined angle, the slide plate 22 is driven to move downward thereby achieving a function of controlling a vertical latch so as to provide the lock with a function of multiple latch-locking and thus improving security and burglary resistance of the lock. Oppositely, when the handle shaft F is rotated in a reversed direction, the slide bar 23 is retracted back and the lock latch D is caused to retract back so as to achieve releasing and unlocking. Under this condition, since the first push bar 211 of the rotating member 21 is positioned in the cutoff 22, when the rotating member 21 is rotated by a predetermined angle in the reversed direction, the slide plate 22 is caused to slide up thereby releasing and unlocking the vertical latch.

The example provided previously is concerned about just a preferred way of embodying the present invention and is not intended to impose limitations to the scope of the present invention. Minor modifications and variations that do not depart from the inventive idea of the present invention as defined in the attached claims, are considered within the scope of the present invention.

In summary, the present invention provides a lock that comprises a rectangular lock tongue, a triangular lock tongue, a lock latch, a lock core shaft, and a handle shaft to be operable with a lock tongue control unit and a lock latch control unit to form a multiple-latch-locking lock structure so that the lock may achieve a function of multiple latch-locking comprising latch-locking and unlocking of lock tongues and lock latches and controlling of a vertical latch thereby achieving a purpose of better security and burglary resistance.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A multiple-latch-locking lock structure, comprising:

a casing, which is provided with a rectangular lock tongue, a triangular lock tongue, a lock latch, a lock core shaft, and a handle shaft;

a lock tongue control unit comprising an operation-linking member, which is in a rotatable condition and is provided with a pushing section; a positioning member, which is arranged on the operation-linking member and in a rotatable condition and is provided with a point projection; a arresting member, which is arranged on the operation-linking member and in a rotatable condition and is provided with a push bar; a swinging member, which has an end overlapping the positioning member and in a rotatable condition and an opposite end provided with a constraining section; a slide block, which is provided, in an upper portion thereof, with a positioning hole and a second positioning hole and is provided, in a lower portion thereof, with a fitting hole, such that the point projection of the positioning member is fit in and received in the fitting hole to drive the slide block to move up and down, so that when the lock core shaft is rotated, the operation-linking member is caused to move downward and drive the positioning member and the swinging member and the arresting member to operate so as to have the arresting member push the rectangular lock tongue out of the casing and also have the swinging member push the triangular lock tongue out of the casing to achieve latch-locking; and a lock latch control unit comprising a rotating member, which is provided with a first push bar and a second push bar that defines an angle of substantially 90 degrees with respect to the first push bar; a slide plate, which is arranged under the rotating member and is provided with a cutoff and the elongate hole, such that the elongate hole is fit over a projecting pillar provided on the casing and the first push bar of the rotating member is set in the cutoff; a slide bar, which has an end provided with a projecting pillar fit into and received in an elongate hole formed in the casing and an opposite end having an upper portion and a lower portion that are respectively provided with an engagement bar and a positioning rod, the positioning rod being provided with a positioning hole; and a positioning plate, which is rotatably mounted to the casing and is provided with a projecting rod, such that the projecting rod is fit into and received in the positioning hole of the positioning rod of the slide bar, wherein when the handle shaft is rotated, the slide bar is pushed forward to push the lock latch out to achieve security latch-locking.

2. The multiple-latch-locking lock structure according to claim 1, wherein a spring having a point-tip protrusion is provided on the upper portion of the slide block of the lock tongue control unit such that the point-tip protrusion is selectively receivable in one of the first positioning hole and the second positioning hole and the point projection of the positioning member is receivable in the fitting hole, wherein when the slide block is moved up and down, the point-tip protrusion of the spring is caused to engage with the first positioning hole or the second positioning hole to achieve positioning and providing improved security.

3. The multiple-latch-locking lock structure according to claim 1, wherein the constraining section has raised and recessed edge surfaces.

4. The multiple-latch-locking lock structure according to claim 1, wherein the slide block of the lock tongue control unit is arranged at an upper portion inside the casing.

* * * * *